US005899152A

United States Patent [19]

Bardsley et al.

[11] Patent Number: 5,899,152

[45] Date of Patent: May 4, 1999

[54] YARN FEED SYSTEM FOR A TUFTING MACHINE

[75] Inventors: Harold B Bardsley, Euxton Nr. Chorley; Arthur F Bagnall, Whitefield, both of United Kingdom

[73] Assignee: Spencer Wright Industries, Dalton, Ga.

[21] Appl. No.: 08/988,670

[22] Filed: Dec. 11, 1997

[30] Foreign Application Priority Data

Dec. 12, 1996 [GB] United Kingdom ..... 9625881

[51] Int. Cl.[6] ..... D05C 11/12

[52] U.S. Cl. ..... 112/80.73

[58] Field of Search ..... 112/80.7, 80.73, 112/80.01, 98, 302

[56] References Cited

U.S. PATENT DOCUMENTS

| | | | |
|---|---|---|---|
| 3,103,903 | 9/1963 | Broadrick et al. | 112/80.73 |
| 3,835,797 | 9/1974 | Franks et al. | 112/80.73 |
| 3,906,876 | 9/1975 | Fitton | 112/80.73 |
| 3,955,514 | 5/1976 | Prichard et al. | 112/80.73 |

FOREIGN PATENT DOCUMENTS

| | | | |
|---|---|---|---|
| 1421594 | 1/1976 | United Kingdom | 112/80.73 |

*Primary Examiner*—Ismael Izaguirre
*Attorney, Agent, or Firm*—Alan Ruderman

[57] ABSTRACT

A yarn feed system (10) for a tufting machine comprises multiple pairs of feed rollers (11, 12) disposed one pair above the other. One of each pair of rollers (12) comprises multiple independent side-by-side axially aligned feed roller elements (13), each roller element (13) being mounted on a tufting machine in a releasable mounting (17, 18). In use the feed roller elements (13) can be released from the mounting (17, 18) if it is required to change the pattern to be produced in a tufted fabric or a thread breaks and the yarn feed system of the invention minimises the amount of rethreading necessary in these circumstances.

15 Claims, 3 Drawing Sheets

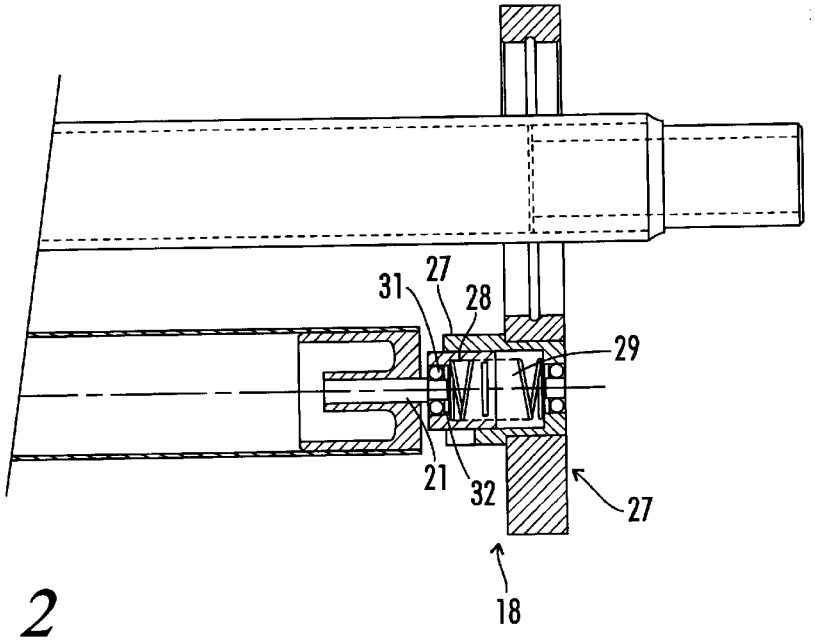
FIG. 2
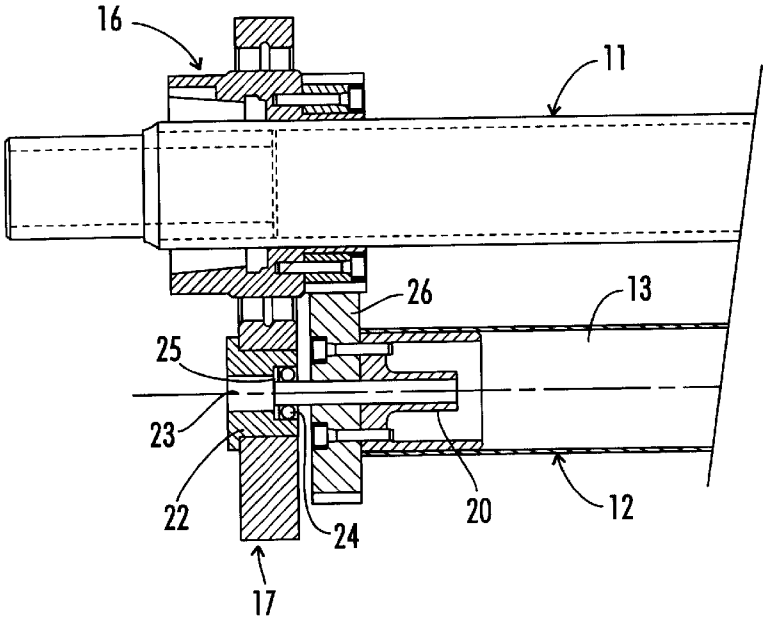

YARN FEED SYSTEM FOR A TUFTING MACHINE

BACKGROUND OF THE INVENTION

This invention relates to an improved yarn feed system to deliver yarn from a yarn supply to reciprocating needles of a tufting machine. In particular the yarn feed system has particular application where a number of differently coloured or different types of yarn are fed to different needles in a particular sequence across the width of the machine to produce a predetermined pattern in the tufted fabric.

Conventionally where it is required to feed different yarns in a particular sequence to particular needles across the width of a tufting machine it has been proposed to use multiple pairs of rollers situated one above the other, each pair of rollers extending the full width of the machine and being operable to deliver a selected group of yarns to selected needles of the machine. In arrangements of this type all yarns pass from yarn supplies to one side of the pairs of feed rollers and particular yarns are selected and fed around the required pair of feed rollers and to the desired needles whereby when the machine is operated the pairs of feed rollers can be driven to allow the desired pattern to be produced in the tufted fabric. All feed rollers are fixed within the machine and are not easily removable.

A problem arises with these known arrangements insofar as it can be difficult to rethread yarns which have become broken or which require changing for any other reason. This arises because the yarn feed rollers are fixed in position in the machine and therefore to change the sequence of yarns for a new pattern it is usually necessary to disconnect most or all of the yarns from the feed rollers. All of the disconnected yarns are then required to be rethreaded to allow the machine to become operational again. This task is necessarily time consuming and will result in significant machine down time.

SUMMARY OF THE INVENTION

It is an object of the present invention to provide an improved yarn feed system which overcomes or at least minimises these problems.

Thus, and in accordance with the present invention therefore, there is provided a yarn feed system for a tufting machine, said system being operable to supply yarns to respective needles of a tufting machine in a predetermined sequence thereby to produce a tufted fabric in a desired pattern, said yarn feed system comprising multiple pairs of feed rollers around which selected yarns are fed from one or more yarn supplies to needles of a tufting machine, wherein at least one roller of each said pair of feed rollers is formed from multiple side by side feed roller elements, each feed roller element being adapted to be releasably mounted in a tufting machine.

With this arrangement it is possible to more easily change any one or more of the yarns passing through the feed rollers since, if a change in the pattern is necessary, as the roller elements are removable and do not extend across full machine width, it is possible to minimise the number of yarns which require rethreading thereby minimising machine down time.

BRIEF DESCRIPTION OF THE DRAWINGS

The invention will now be described further by way of example only and with reference to the accompanying drawings of which:

FIG. 2 shows to a larger scale part of the yarn feed system of FIG. 1.

DESCRIPTION OF THE PREFERRED EMBODIMENT

Figure 1:
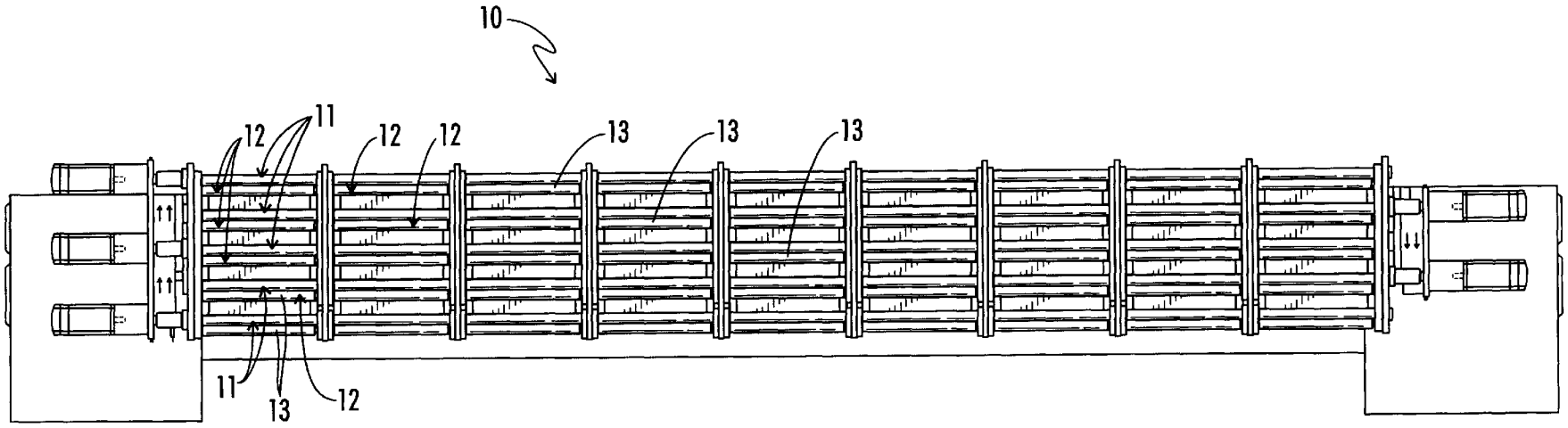
FIG. 1 shows a diagrammatic front view of one form of yarn feed system in accordance with the present invention.
Figure 4:
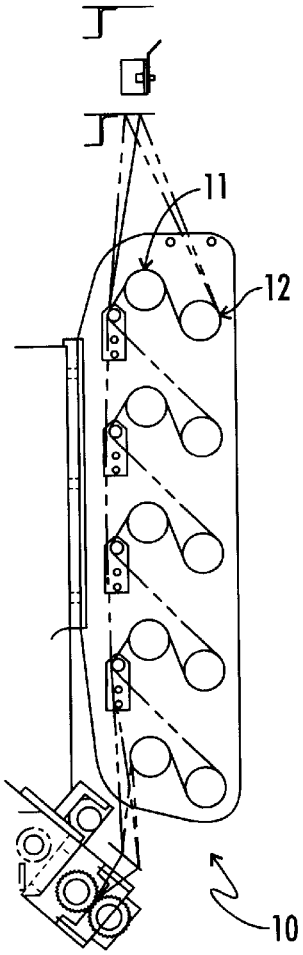
FIG. 4 is a vertical cross sectional view through the yarn feed system illustrated in FIG. 3.

Referring now to FIG. 1, there is shown one form of yarn feed system according to the present invention for use in a tufting machine. The feed system 10 comprises multiple pairs of feed rollers 11, 12 disposed one pair above the other. One of the feed rollers 12 of each pair comprises multiple independent side by side axially aligned feed roller elements 13. In the example shown in FIG. 1, the feed roller 12 comprises nine side by side roller elements 13, however this arrangement is shown for illustration only and the particular number of elements 13 is variable dependent on the particular requirements of the tufting machine in which they are to be used. At least one of each pair of feed rollers 11 or 12 is arranged to be driven in conventional manner by a motor (not shown) and the other roller 11 or 12 is either arranged to be driven by an associated motor or may be drivingly connected together to the driven roller 11 or 12.

FIG. 2 shows to a larger scale a detail of a part of yarn feed roller 11 and element 13. As can be seen, the upper roller 11 of the pair is fixedly mounted in a bearing 16 which is secured to the machine frame. The lower roller element 13 of the pair is removably mounted in mountings 17, 18 secured to the machine frame in a manner to be hereinafter described. The lower roller element 13 has a pin 20, 21 projecting substantially axially from each end thereof.

Figure 3:
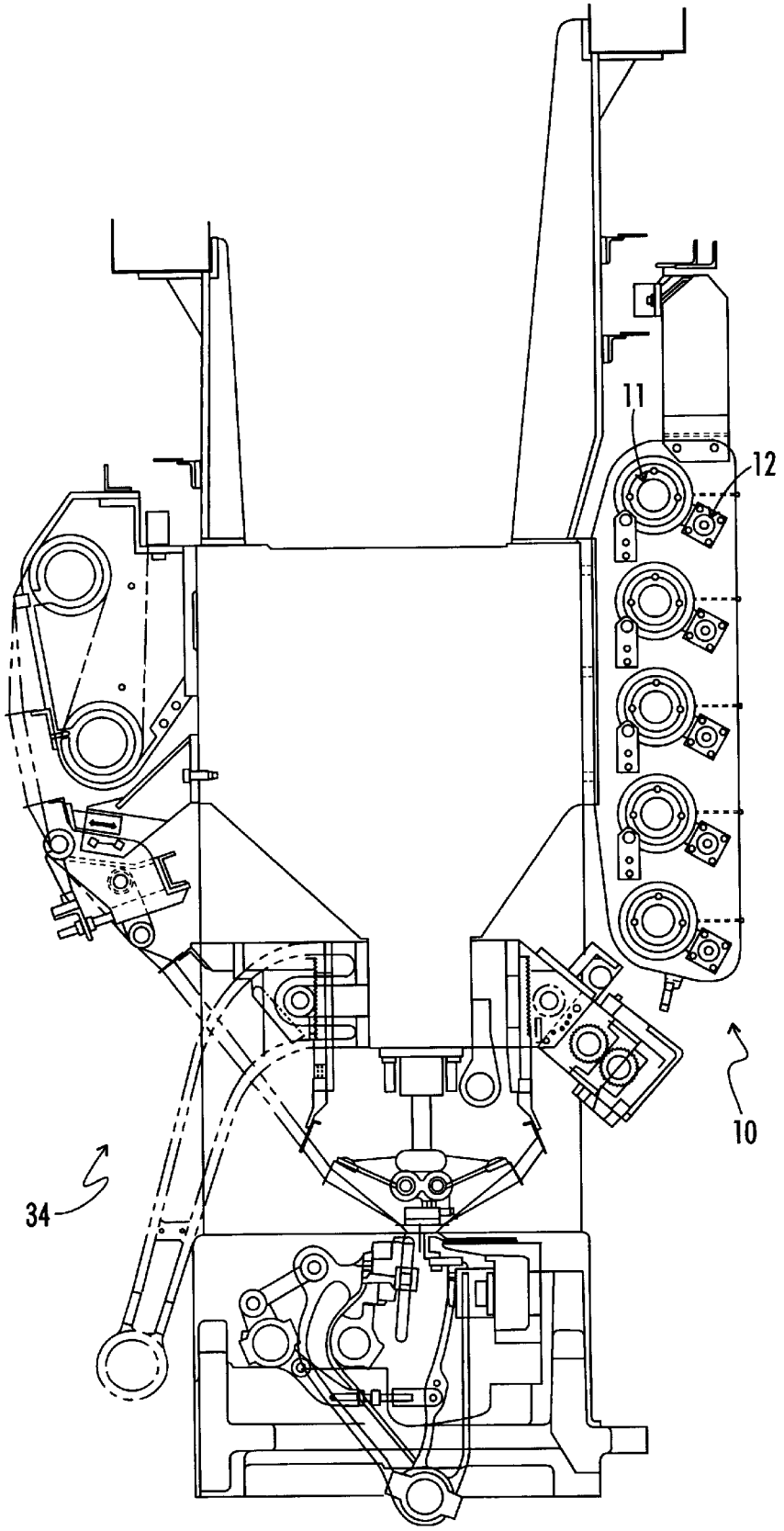
FIG. 3 shows a side view of the yarn feed system of FIG. 1 only with part of a tufting machine in which it is mounted.

Each lower roller element 13 is secured in position by way of two mountings 17, 18, one at each end. The mounting at one end 17 is adapted to receive one end of the roller element simply to locate the same and mount the roller relative to the machine. This mounting 17 comprises a generally cylindrical housing 22 having a central bore 23 therein of substantially larger diameter than the diameter of the pin 20, 21 provided in each end of the roller element 13. In order to locate the roller element 13 in the mounting 17, the pin 20 is located in the bore 23 and is retained therein by a roller bearing 24 on the pin. A rubber seal 25 is disposed between the bearing 24 and a shoulder of the housing 22 acts to minimise any vibration in the rollers whilst being driven. The pin 20 at this end of the roller 13 is also provided with a drive gear 26 thereon which, when the roller 13 is mounted in the mounting 17, the drive gear 26 engages with a suitable drive to allow the roller to be driven. The mounting 18 into which the pin 21 at the other end of the roller 13 is releasably secured comprises a hallow generally cylindrical outer sleeve 27 within which an annular inner sleeve 28 locates so as to be slidably movable longitudinally relative to the outer sleeve 27. The movement of the inner sleeve 28 relative to the outer sleeve 27 is biassed by a spring 29 provided internally of both the inner and outer sleeve 27, 28. Once again a roller bearing 31 is provided across the outer end of the inner sleeve 28 within which the pin 21 locates. A rubber seal 32 is also disposed between the bearing and the spring 29. The movement of the inner sleeve 28 relative to the outer sleeve 27 may be restricted by a limiting means (not shown) which prevents the inner sleeve 28 from being biassed away from the outer sleeve so as to move out of engagement therewith when the roller 13 is released from the mounting 18. The position of the pairs of rollers relative to the tufting instrumentalities of a tufting machine 34 are shown in FIG. 3 the machine being conventional and well known to those skilled in the art.

In use, it is envisaged that the improved yarn feed system of the invention will be of particular application in the case where a machine is to be used for patterning and where selected yarns are fed in a particular sequence to selected needles to produce yarn feed patterns in a tufted fabric. Thus for example, different coloured yarns, or different types of yarns, could be fed to different yarn feed roller pairs to produce a desired pattern in the finished fabric. The yarns are fed from a respective yarn supply around a respective feed roller pair and into the requisite needles in accordance with the pattern. Once each needle which is to be used to produce a particular pattern has been threaded with a yarn around whichever yarn roller pair it is required to be fed to produce a desired pattern, the machine is set up to produce a tufted fabric of a particular selected pattern.

If, during the operation of the machine, it becomes necessary to change the pattern being sewn by the machine in the tufted fabric, it is possible to stop the machine and the removable roller element 13 of the respective roller elements pair 13 around which yarns are threaded and then is removed. The roller elements 13 are removed by sliding the inner sleeve 28, into the outer sleeve 27 against the bias of the spring 29 so that the pin 21 of the roller element 13 may move with the inner sleeve 27 relative to the outer sleeve. The roller element 13 can be removed by pulling the other roller pair out of engagement with the mounting 17 at the opposite end. The yarns which require changing can then be removed and rethreaded. It will be appreciated that by segmenting the feed rollers into multiple roller elements and making these roller elements removable, machine down time is considerably reduced and the ease and convenience of changing a particular sequence in the yarn feed is increased.

It is of course to be understood that the invention is not intended to be restricted to the details of the above embodiment which are described by way of example only.

Having thus set forth the nature of the invention, what is claimed herein is:

1. A yarn feed system for a tufting machine, said system being operable to supply yarns to respective needles of a tufting machine in a predetermined sequence thereby to produce a tufted fabric in a desired pattern, said yarn feed system comprising multiple pairs of feed rollers around which selected yanis are fed from one or more yarn supplies to needles of a tufting machine, wherein at least one roller of each said pair of feed rollers is formed from multiple side-by-side substantially axially aligned feed roller elements, each feed roller element being mounted relative to said tufting machine in a releasable mounting pennitting the roller element to be selectively removable relative to the tufting machine, said mounting comprising two mounting parts positioned so as to receive respective opposite ends of a roller element, a first of said mounting parts and one end of said roller element having cooperating members which locate said one end, and the other of said mounting parts and a second end of said roller elements having cooperating members which penmit said second end to be secured in and resiliently urged axially away from said other of said mounting parts so that the second end may be moved relative to the other mounting to permit said one end to be freed from said first of said mounting parts.

2. A yarn feed system according to claim 1, wherein each roller element is removably mounted on a mounting secured to the frame of a tufting machine.

3. A yarn feed system according to claim 2, wherein one of each said pair of feed rollers is driven and the other of said pair is drivingly connected to the driven roller.

4. A yarn feed system according to claim 3, wherein said one of said pair of rollers which comprises multiple elements is drivingly connected to the other of said pair which is driven.

5. A yarn feed system according to claim 4, wherein a first of said pair of feed rollers is mounted above a second of said feed rollers, so as to define an upper and a lower feed roller, said lower feed roller comprising multiple roller elements.

6. A yarn feed system according to claim 2 wherein said other of said mounting parts comprises a generally cylindrical housing having a sleeve therein into which an extension member of the roller element is received and located relative to the frame of the tufting machine, and a spring acting resiliently to urge said sleeve out of said housing toward said first of said mounting parts.

7. A yarn feed system according to claim 6, wherein a roller bearing is provided within said sleeve to retain said extension member of said roller element therein, and said spring acts intermediate said bearing and said housing.

8. A yarn feed system according to claim 7, wherein a rubber seal is disposed between the bearing and the housing to minimize vibration when the roller element is driven.

9. A yarn feed system according to claim 1, wherein the other mounting part comprises a generally cylindrical outer sleeve internally of which is mounted a moveable inner sleeve, said inner sleeve being capable of longitudinal movement relative to the outer sleeve.

10. A yarn feed system according to claim 9, wherein the movement of the inner sleeve is resiliently biased by a spring.

11. A yarn feed system according to claim 9, wherein a limiting means is provided which limits movement of the inner sleeve relative to the outer sleeve.

12. A yarn feed system as recited in claim 1, wherein one of said mounting parts comprises a generally cylindrical housing having a bore therein into which a part of the roller element is received so as to be located relative to the frame of a tufting machine.

13. A yarn feed system as recited in claim 12, wherein a roller bearing is provided within said bore to retain said part of said roller element therein.

14. A yarn feed system as recited in claim 13, wherein a rubber seal is disposed between the bearing and the housing to minimize vibration when the roller element is driven.

15. A yarn feed system as recited in claim 10, wherein a limiting means is provided which limits movement of the inner sleeve relative to the outer sleeve.

* * * * *